US005701051A

United States Patent [19]

Lin

[11] Patent Number: 5,701,051

[45] Date of Patent: Dec. 23, 1997

[54] MINIATURE LAMP

[76] Inventor: Blake Lin, 24, Lane 77, Chung Shan Road, San Chung City Taipei Hsien, Taiwan

[21] Appl. No.: 602,037

[22] Filed: Feb. 15, 1996

[51] Int. Cl.[6] ..... H01R 33/00

[52] U.S. Cl. ..... 313/318.1; 313/318.09; 362/249; 362/389; 362/226; 362/448; 362/806

[58] Field of Search ..... 313/318.01, 318.05, 313/318.1, 318.09; 439/611, 617; 362/448, 806, 226, 249, 389

[56] References Cited

U.S. PATENT DOCUMENTS 4,939,899 7/1990 Tseng ..... 362/226

5,001,615 3/1991 Stefanelli ..... 362/226

5,331,529 7/1994 Huang ..... 313/318.1 X 5,428,516 6/1995 Harris ..... 362/226

5,498,922 3/1996 Chang ..... 313/318.1

*Primary Examiner*—Ashok Patel

*Attorney, Agent, or Firm*—Myron Amer, P.C.

[57] ABSTRACT

A miniature lamp, as typically used as a Christmas tree decoration, in which an integral light bulb and base is held in its inserted position within a cooperating socket by latching tongues that, when providing their latching function, assume an out-of-the-way position that minimizes any contact that inadvertently would cause an unlatching of the tongues and consequent release of the light bulb and base.

1 Claim, 2 Drawing Sheets

MINIATURE LAMP

The present invention relates generally to miniature lamps, of the type typically used as a Christmas tree adorning decoration, and more particularly to improvements in obviating inadvertent disengagement of the integral base and miniature lamp assemblies from their cooperating sockets.

EXAMPLES OF THE PRIOR ART

As an article of manufacture, miniature lamps having the end use noted are already well known, as exemplified by U.S. Pat. No. 4,943,899 issued to Jeow N. Tseng for "Socket and Bulb Snap Fastener for Christmas Light Strings" on Jul. 24, 1990, by U.S. Pat. No. 5,001,615 issued to Anthony Stefanelli for "Positive Interlock Assembly" on Mar. 19, 1991, and by U.S. Pat. No. 5,428,516 issued to Geoffrey H. Harris for "Interlock for Miniature Lamp Arrays" on Jun. 27, 1995, to mention just a few. The selection of this prior art demonstrates not only general knowledge of the product but also, as the titles of the referenced patents imply, prior art efforts to obviate inadvertent disengagement of the bulb-base assembly from its cooperating socket.

These prior efforts contemplate use of tongue(s) laterally extending from the base which fold down and engage laterally extending projections on the socket, thus resulting in a latching of the base in place within the socket. The socket projections as above noted extend radially of the socket and, unavoidably, hold the tongues that are latched thereto in a clearance position from the surface of the socket. In practice, inadvertent contact with the thusly positioned latching tongues often results in undoing of the latching and disengagement of the bulb-base assembly from the socket.

Broadly, it is an object to provide a latched-together bulb-base assembly and socket overcoming the foregoing and other short-comings of the prior art.

More particularly, it is an object to achieve, using one or more latching tongues, not only effective latching engagement, but also an out-of-the-way latching or storage position for the tongues which obviates any inadvertent contact which undermines the utility of the latching tongues, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 6:
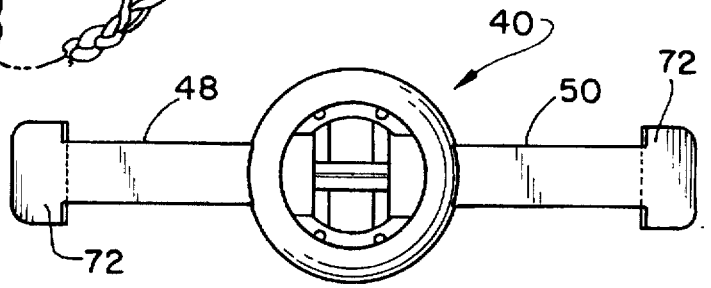
Figure 8:
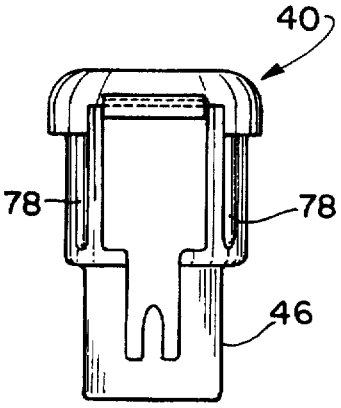
Figure 7:
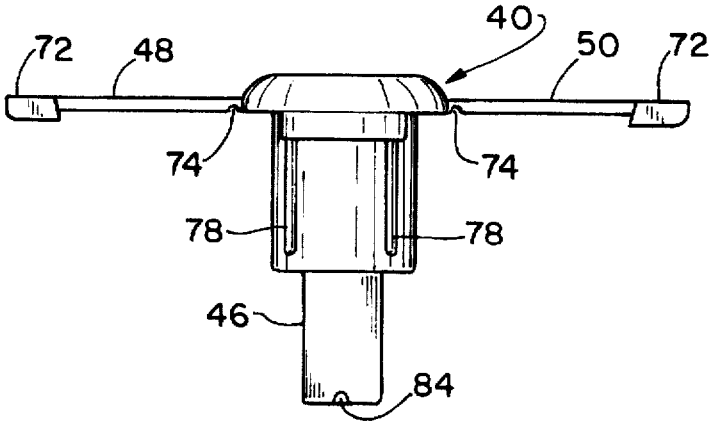
Figure 9:
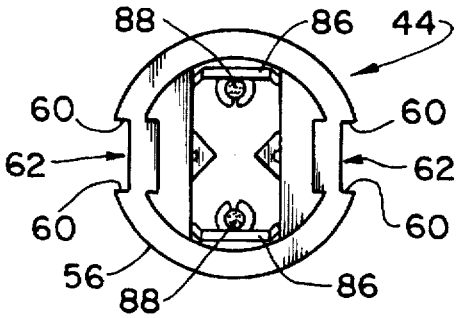
Figure 11:
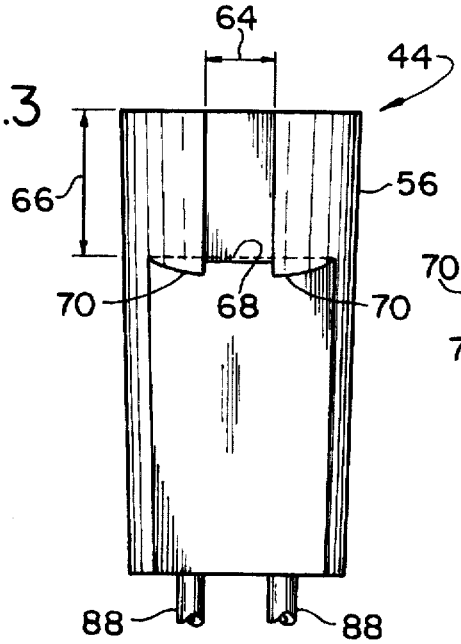
Figure 10:
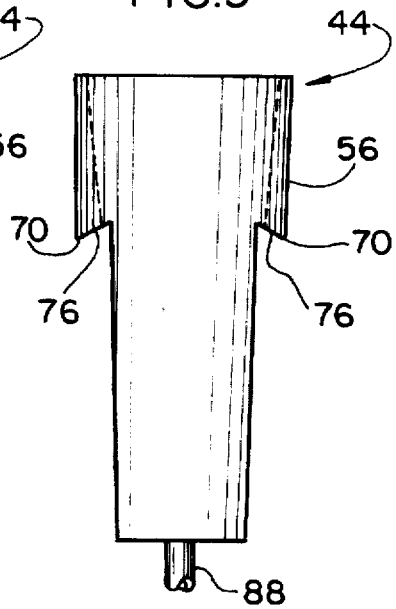

FIGS. 6, 7 and 8 respectively are plan, front and one side elevational views of the base component of the within inventive miniature lamp, of which the rear and other side are identical to said noted front and one side elevational views; and FIGS. 9, 10 and 11, like FIGS. 6, 7 and 8, are respectively plan, front and one side elevational views, but of the socket component of the within inventive miniature lamp.

Figure 1:
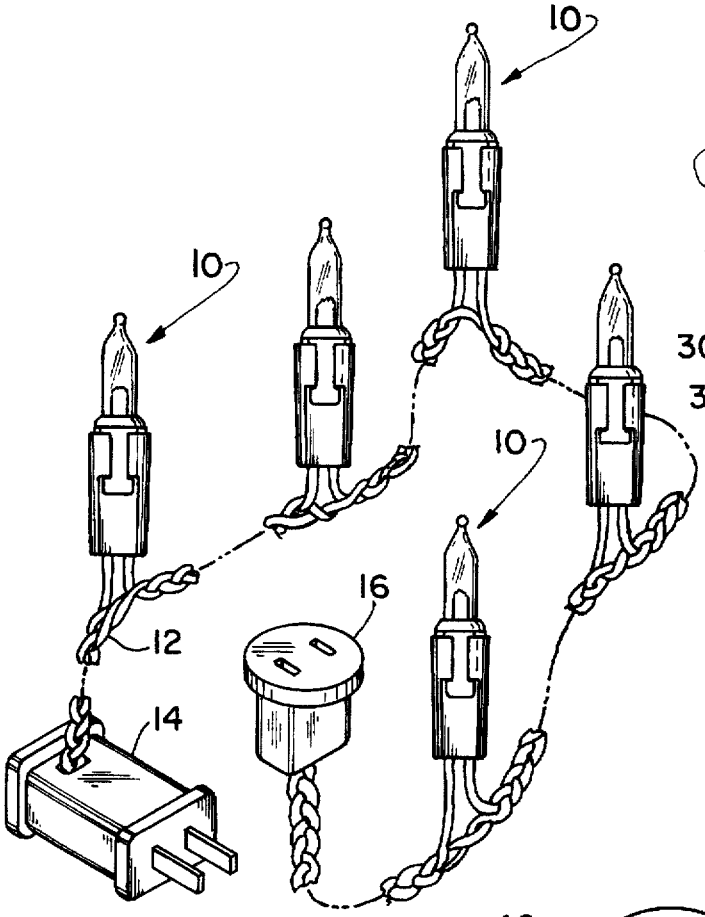
FIG. 1 is a perspective view of plural miniature lamps in accordance with the present invention in a typical end use.

The present invention relates to an improved miniature lamp 10 which, as best understood from FIG. 1, is part of a light display comprised of plural miniature lamps electrically connected to known electric circuit means 12 having a male plug 14 at one end for connection to a source of electricity and, at its opposite end, a female plug 16 which typically has connected to it another FIG. 1 light display plug 14 to produce a light display long enough to be positioned, in a typical end use, in encircling relation about a Christmas tree, garden hedges on holiday occasions, and the like, to contribute to enhancing the appearance of the object adorned with the light display.

Figure 2:
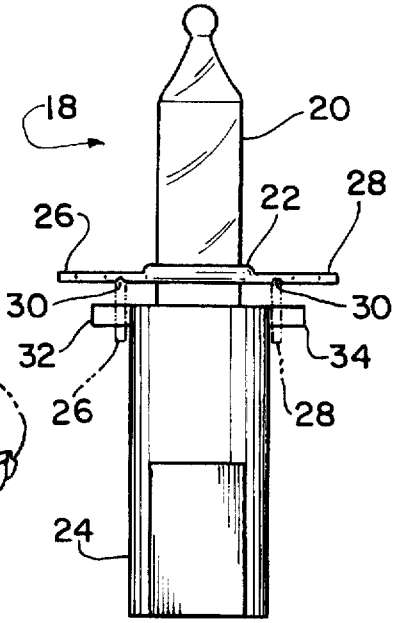
FIG. 2 is a front elevational view of a prior art miniature lamp for comparison with the within inventive miniature lamp.

A miniature lamp, absent the improvements of the within inventive miniature lamp 10 soon to be described, is a known article of manufacture, being designated 18 in FIG. 2 and to be understood to be exemplified by the miniature lamp described and illustrated in U.S. Pat. No. 4,943,899 issued to Jeow N. Tseng for "Socket and Bulb Snap Fastener for Christmas Light Strings" on Jul. 24, 1990. The prior art construction of the miniature lamp 18 includes an integral light bulb 20 and base 22 having an operative inserted position, as illustrated in FIG. 2, in a cooperating socket 24 and, in addition to a friction fit to maintain said operative inserted position, and more particularly to obviate inadvertent twisting of the light bulb and base assembly 20, 22 within the socket 24, there is provided a pair of laterally extending tongues 26 and 28 which fold, at fold lines 30, from horizontally oriented starting positions noted in full line perspective to vertically oriented positions noted in phantom perspective, which results in the tongues 26 and 28 latching over cooperating laterally extending projections 32 and 34.

Figure 3:
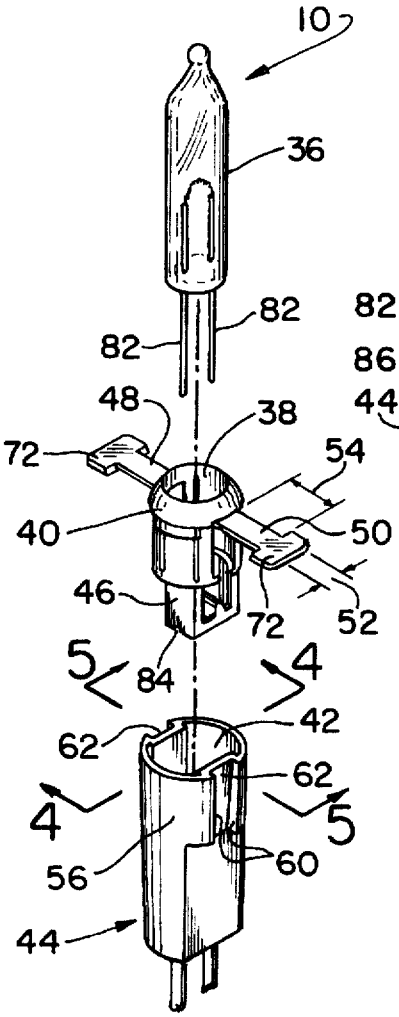
FIG. 3 is an exploded perspective view of the components of the inventive miniature lamp.
Figure 4:
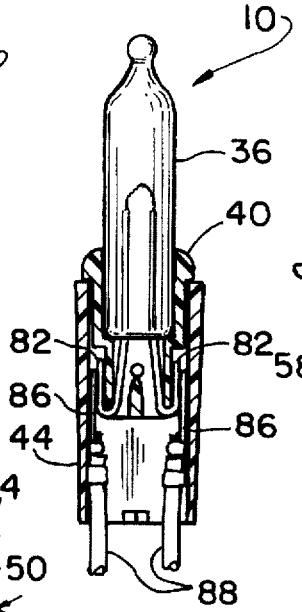
FIG. 4 is a sectional view, as taken along line 4—4 of FIG. 3, of said lamp in assembled condition.
Figure 5:
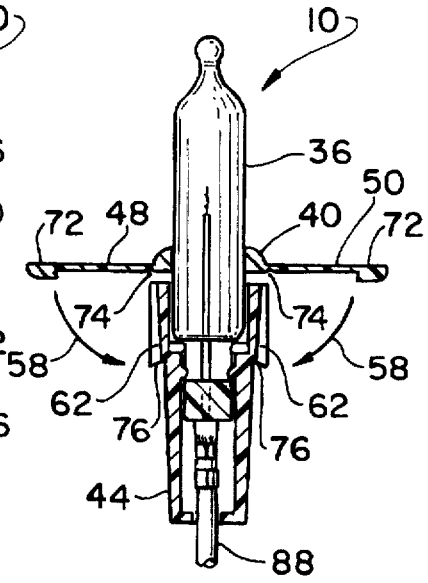
FIG. 5 is similarly a sectional view of said assembled miniature lamp, as taken along line 5—5 of FIG. 3.

Miniature lamp 10, like its prior art counterpart of FIG. 2, also includes, as best understood from FIGS. 3, 4 and 5, a light bulb 36 made integral in an appropriate manner in an inserted operative position within a bulb-receiving compartment 38 of a base 40, and said assembly of bulb and base 38, 40 in turn having an inserted operative position within a compartment 42 in a socket 44 sized and configurated to receive the assembly 36, 40. The configuration of compartment 42 is generally rectangular, as is the external housing 46 of the base 40 which obviates inadvertent twisting of the latter in the former, but this configuration matching will, of course, not obviate inadvertent disengaging ascending movement of the bulb and base assembly 36, 40 from the socket compartment 42.

The improvements embodied in the within miniature lamp 10 effectively prevent the inadvertent disengagement just noted and constitute the patentable advance over the prior art miniature lamp 18 and all other known miniature lamps. These improvements include, in a preferred embodiment, latching means in the specific form of a pair of tongues 48 and 50, each of a flat rectangular shape comprised of plastic construction material being preferably injection molded as part of the base 40, and each tongue 48, 50 being of a selected width 52 and length 54. Wall means 56 of the socket 44 destined to be in the path of folding movement 58 (FIG. 5) of each tongue 48, 50 is molded or otherwise appropriately provided with vertically oriented spaced-apart edges 60 bounding a slot 62 therebetween of a prescribed horizontal width 64 and vertical length 66 and of a depth approximately equal to the thickness of the tongues 48, 50. More particularly, the slot horizontal width 64 is slightly oversized in relation to the width 52 of each tongue 48, 50, and the slot vertical length 66 is slightly undersized in relation to the length 54 of each tongue 48, 50.

Also to be noted, at the bottom location 68 (FIG. 11) of each slot 62 and, more particularly, on opposite sides of and adjacent the slot edges 60, the wall means 56 presents laterally extending tongue-engaging surfaces or projections 70. Cooperating with the projections 70 are rectangular-shaped configurations 72 on the free end of each tongue 48, 50 which configurations 72 in the strategic location noted are adapted in a folded down condition of the tongues 48, 50 to assume an operative position beneath the projections 70 and, in this manner, to contribute to a latched condition of the bulb and base assembly 10, 40 to the socket 44. Also significant, the tongues 48, 50 in their positions within the confines of a cooperating slot 62 are in an out-of-the-way condition in relation to possible inadvertent contact that could result in unlatching or disengagement of the tongue configurations 72 from the base projections 70.

To facilitate the fold-down traverses 58 of the tongues 48, 50, a transverse notch 74 is provided in the underside of each tongue 48, 50. Also, to contribute to maintaining the tongue latching configurations 72 seated beneath the projections 70, the projection surface 76 is inclined at a slight angle below the horizontal, such as 30 degrees.

For completeness sake it is noted that four radially extending ridges 78 are circumferentially spaced about the external surface 80 of the base 44 to contribute to a snug or friction fit of the base 44 within the socket 44, and that depending electrical wires 82 are each folded, after insertion of the light bulb 10 in the base, upwardly in a notch 84 (FIG. 7) into an electrical connection 86 with the power lead wires 88 of the socket.

From the foregoing description it should be readily appreciated that the latching function of the tongues 48, 50 to hold the bulb and base assembly 10, 40 in the socket 44 is supplemented by the additional latching function resulting from the latched connection of the tongue configurations 72 beneath the socket projections 70, to effectively hold the latching tongues 48, 50 in place, all to the end of effectively obviating inadvertent disengagement of the assembly 10, 40 from the socket 44.

While the miniature lamp herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. For use in a light display for a selected object an improved miniature lamp having an integral light bulb and base having an operative inserted position in a cooperating socket and held in place in said inserted position by at least one latching means hingedly connected in laterally extending relation from said base and folded in depending relation over said socket into engagement with a latch connection on said socket, said improvements for said miniature lamp comprising said at least one latching means being of a flat rectangular tongue of a prescribed width and length, wall means on said socket in the path of said folding movement of said tongue having vertically oriented spaced apart edges bounding a slot therebetween of a prescribed horizontal width and vertical length, said slot horizontal width being slightly oversized in relation to said width of said tongue and said slot vertical length being slightly undersized in relation to said tongue length, said wall means on opposite sides of said slot presenting a laterally extending tongue-engaging surface, and a triangular-shaped configuration on a free end of said tongue having opposite projections sized to extend laterally of said slot such that in said operative folded-over position of said tongue said projections contribute to a latched connection to said tongue-engaging surface, wherein said integral bulb and base is held in place in said socket and said latching tongue held in place in said slot.

* * * * *